US006450491B1

(12) United States Patent
McEvoy

(10) Patent No.: US 6,450,491 B1
(45) Date of Patent: Sep. 17, 2002

(54) CLAMP FOR MULTI-CORNERED STRUCTURES

(76) Inventor: Rex McEvoy, 717 Ramage St., West Hollywood, CA (US) 90069

( * ) Notice: Subject to any disclaimer, the term of this patent is extended or adjusted under 35 U.S.C. 154(b) by 66 days.

(21) Appl. No.: 09/706,882

(22) Filed: Nov. 6, 2000

(51) Int. Cl.[7] ..... B25B 5/14

(52) U.S. Cl. ..... 269/118; 269/109; 269/115; 269/42; 269/130

(58) Field of Search ..... 269/118, 104, 269/109, 111, 115, 116, 117, 124, 125, 42, 286, 108, 112, 41; 228/130–132, 47.1, 44.3; 249/48, 67, 170, 171, 219 R, 219 W, 219

(56) References Cited

U.S. PATENT DOCUMENTS

| | | | | | |
|---|---|---|---|---|---|
| 3,650,521 | A | * | 3/1972 | Meli | 269/41 |
| 3,795,393 | A | * | 3/1974 | Melfi | 269/116 |
| 4,047,710 | A | * | 9/1977 | Wilson | 269/42 |
| 4,211,391 | A | * | 7/1980 | Strasser | 269/41 |
| 4,926,722 | A | | 5/1990 | Sorensen | |
| 5,009,134 | A | | 4/1991 | Sorensen | |
| 5,022,137 | A | | 6/1991 | Sorensen | |
| D320,919 | S | | 10/1991 | Sorensen | |
| 5,161,789 | A | * | 11/1992 | Rogers | 269/42 |
| 5,411,244 | A | * | 5/1995 | Turner | 269/42 |
| 6,209,859 | B1 | * | 4/2001 | Chung | 269/111 |
| 6,391,144 | B1 | * | 5/2002 | Gilbert | 156/304.1 |

FOREIGN PATENT DOCUMENTS

| | | |
|---|---|---|
| TW | 38644 | 1/1991 |

OTHER PUBLICATIONS

Copy of Front & Back Label For a Variable Angle Strap Clamp (2pages).
Copy of Front & Back Label for a "Quick–Grip" Bar Clamp ( 1 page).
Copy of Front & Back Label for a Caukling Gun No. JM 117 ( 1 page).

* cited by examiner

*Primary Examiner*—Joseph J. Hail, III
*Assistant Examiner*—Daniel Shanley
(74) *Attorney, Agent, or Firm*—Trojan Law Offices

(57) ABSTRACT

A framing clamp for the assembly and construction of multiple sided and multiple-cornered structures employing a ratchet assembly with a multitude of clamp braces to provide constant tension on a object and to also provide a easy mode of adjusting the clamp with a ratchet assembly.

10 Claims, 5 Drawing Sheets

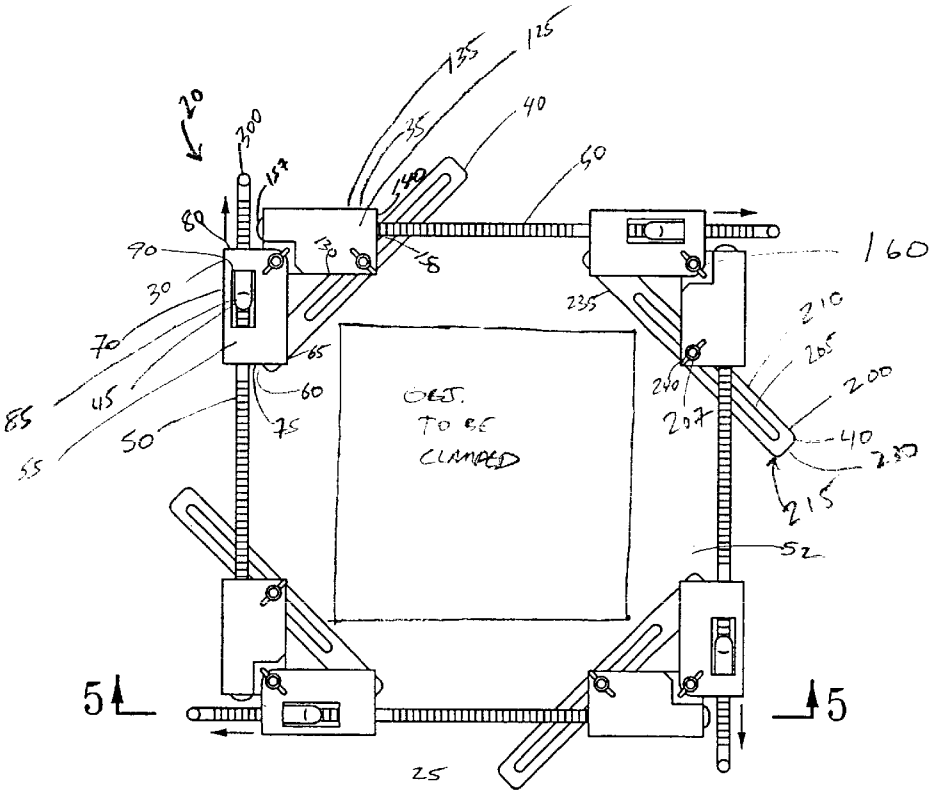
OBJECT TO BE CLAMPED
5
5
25
20
160
200
210
220
230
240
245
250
260
270
280
290
300
310
315
320
330
340
350
360
370
380
390
400
410
420
430
440
450
460
470
480
490
500
510
520
530
540
550
560
570
580
590
600
610
620
630
640
650
660
670
680
690
700
710

CLAMP FOR MULTI-CORNERED STRUCTURES

BACKGROUND OF THE INVENTION

1. Field of the Invention

A clamp for the assembly and construction of multiple sided and multiple-cornered structures and objects.

2. Description of Related Art

The main difficulty in constructing an object with multiple sides and corners, such as a frame or shadow box, is maintaining equal pressure to all sides of the frame or shadow box to allow permanent connection with the glue or adhesive or with nails or clips. The current products on the market employ straps to hold different sized objects together during assembly. These strap systems may fit around some odd shaped items, but these straps get in the way of the glue or adhesive that normally seeps from the joints and can get stuck to the item being strapped. Further, straps may not provide the consistent tension required to hold the sides in place because straps can stretch and slip, and the user may have difficulty in adjusting the straps.

From the preceding descriptions, it is apparent that the current frame holders currently being used have significant disadvantages. Thus important aspects of the technology used in this field of invention remain amenable to useful refinement.

SUMMARY OF THE INVENTION

The object of the present invention is to provide a device to easily hold and to steady a frame or shadow box during assembly and/or gluing that allows for an exacting and uniform adjustment of equal pressure on all sides and levels of a frame or shadow box.

Another object of this invention is to provide a method of using said device to easily hold and to steady a frame or shadow box during assembly and/or gluing.

This present invention improves on this bracing concept by combining a ratchet assembly within a brace support for frames and shadow boxes. This ratchet assembly takes advantage of the ability of a ratchet to constantly hold the item but still allows for accurate and even adjustment. Instead of twisting a screw or adjusting a strap or a vice, the user simply adjusts the ratchet handle to tighten the holder. Since the spaces between the teeth of the ratchet are close apart, the user can make fine adjustments to provide the proper support of the framing project.

This invention also includes an embodiment with the ratchet assembly outside the brace support units for square or rectangular shaped items. The present invention introduces such refinement. All of the foregoing operational principles and advantages of the present invention will be more fully appreciated upon consideration of the following detailed description, with reference to the appended drawings.

BRIEF DESCRIPTION OF THE DRAWINGS

FIG. 1 is an overview of one embodiment of the claimed invention with four sides;

FIG. 2 is an overview of another embodiment of the claimed invention with three sides;

DESCRIPTION OF THE PREFERRED EMBODIMENTS

Figures 3, 4, 11:
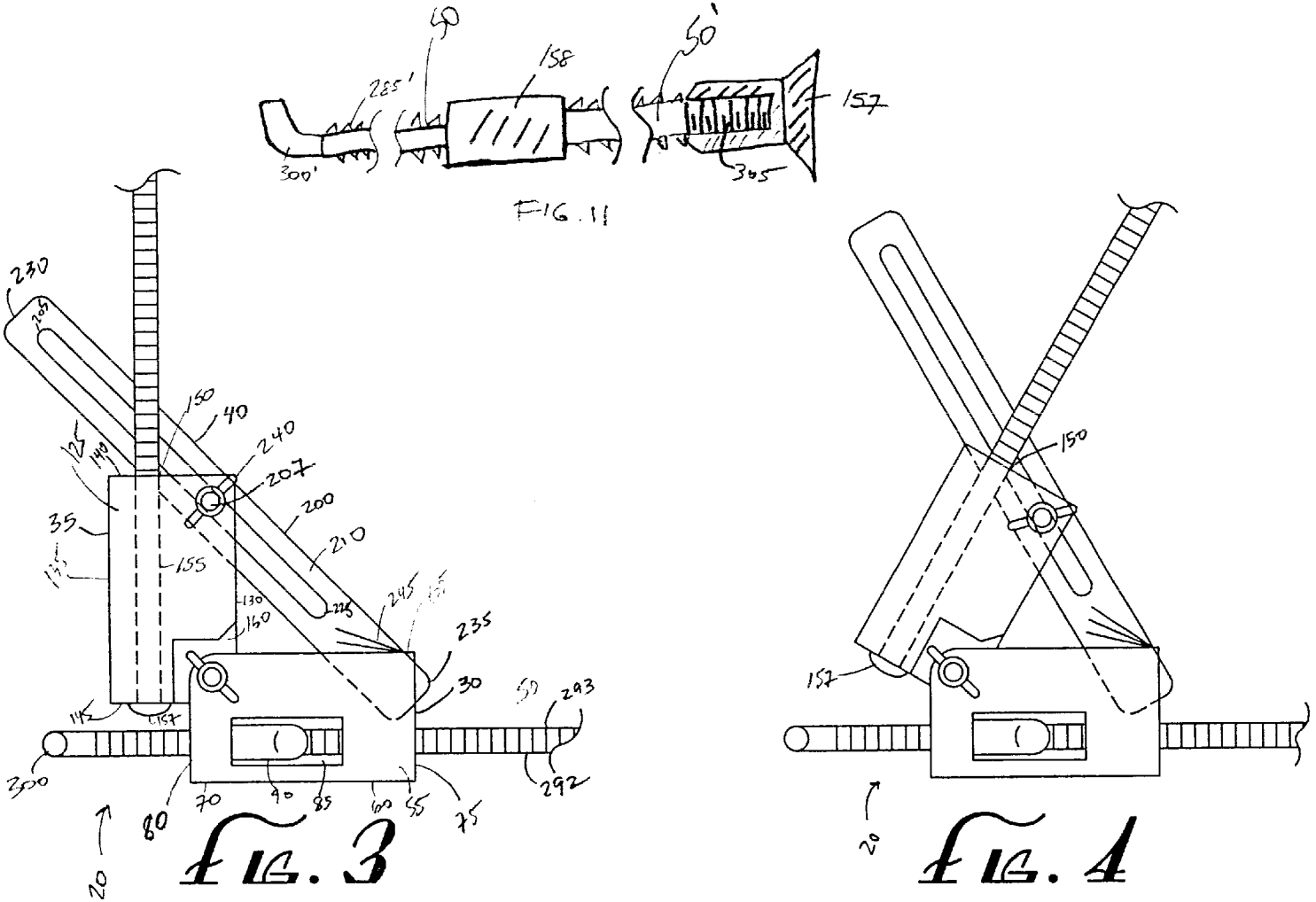
FIG. 3 is an above view of a closeup of the clamping brace of FIG. 1.
FIG. 4 is an above view of a closeup of the clamping brace of FIG. 2.
FIG. 11 is a cross-sectional view of an extension of the tension bar of the clamping brace.

This present invention combines a ratchet assembly with brace supports for the assembly of multi-sided objects such as frames and shadow boxes. This ratchet assembly takes advantage of the ability of a ratchet to constantly hold the item but still allows for accurate and even adjustment. Instead of twisting a screw or vice, the user simply adjusts the ratchet assembly by pressing on the ratchet handle multiple times to tighten the clamp.

Further since the teeth of the ratchet assembly are offset by approximately 1/16 inch, the user can make fine adjustments to provide the proper support of the framing project. This invention also has an embodiment wherein the ratchet assembly is positioned outside the brace support units for use with square or rectangular shaped items.

FIGS. 1–6 show a framing clamp 25 for a frame, a shadow box, or any object to be framed or clamped. At each corner of frame, there are a plurality of corners, and there is a corner assembly 20 at each corner. Each corner assembly 20 has a first corner arm 30 removably and pivotally connected to a second corner arm 35, which is removably and pivotally connected to a bottom swivel support 40. The first and second arms 30 and 35 each have a rigid tension bar 50 extending therefrom and adjustably connecting to a corner arm of the another corner assembly. As a result, these tension bars 50 and corner assemblies 20 define an interior space 52 in which a frame, a shadow box, or any object to be framed or clamped, can be placed. When the frame is within this interior space 52, the framing clamp 25 may be tightened to prevent any movement of the frame during drying of the glue or adhesive. Both the first corner arm 30 and the second corner arm 35 can rest on the bottom swivel support 40, which provides a bracing and resting support for the corner of the object to be clamped.

Figures 5, 6:
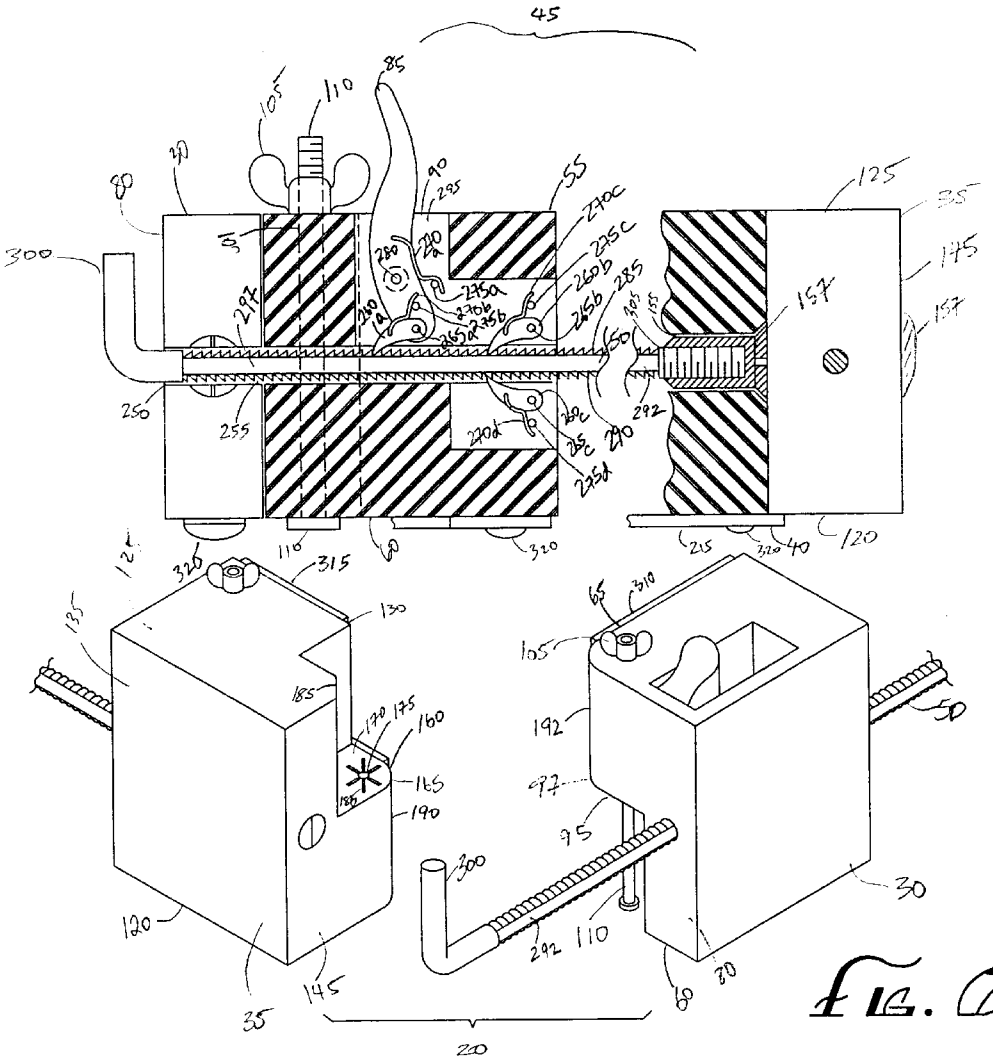
FIG. 5 is a cross-section view of the ratchet assembly in the first corner arm of one clamp and the adjacent second corner arm of an adjacent clamp of FIGS. 1 and 2.
FIG. 6 is a view of the unassembled pieces of the clamping brace of FIGS. 1 and 2.

The first corner arm 30 has a contact surface 65, which touches the corner of the frame, and an outer surface 70. In the embodiment shown in FIGS. 1–6, there is also a top surface 55, a bottom surface 60, an outer first corner arm surface 75, and an inner first corner arm surface 80. In FIG. 5, within the first corner arm 30, there is a ratchet assembly 45, a tension bar 50, and a ratchet handle 85.

In addition, the first corner arm 30 also has a handle window 90, which opens up on the outer surface 70, or as shown in the FIGS. 1 and 3, on the top surface 55 of the first corner arm 30, to allow access to the ratchet handle 85 so that the user can press down on the ratchet handle 85 to activate the ratchet mechanism and to adjust the position of the tension bar 50 and the framing clamp.

In FIG. 6, the first corner arm 30 has a recess 95 starting from the bottom surface 60 to the midpoint 97 at a corner of the inner first corner arm surface 80 and the contact surface 65. In FIGS. 5 and 6, the first corner arm 30 also has a pivot pin hole 100 to accommodate a wing nut 105 and a pivot pin 110 for pivoting and removably connecting the first corner arm 30 to the second corner arm 35.

The second corner arm 35 has a contact surface 130 and an outer surface 135 in FIGS. 1–6. In the embodiment shown in FIGS. 1–6, the second corner arm 35 also has a bottom surface 120, a top surface 125, an outer second corner arm surface 140, and an inner second corner arm surface 145.

In FIG. 1, the tension bar 50 from the adjacent corner assembly enters a channel opening 150 on the second corner arm 35. In FIG. 3, the tension bar 50 passes through a channel 155 of the second corner arm 35.

In FIG. 5, the tension bar 50 has two ends: an L-shaped end 300 and a retention end 305. The retention end 305 of tension bar 50 removably connects with a screw head 157; the retention end 305 is the male part, which removably connects to the screw head 157, the female part. The screw head 157 does not interfere with the tension bar 50 in the first corner arm 30.

To remove or to add another tension bar 50, the user would simply unscrew the screw head 157 from the retention end 305 of the tension bar 50, which allows for easy removal or addition of a tension bar or an extension. In FIG. 11, the length of the tension bar 50 can be increased by removably attaching a connection adapter 158 to another tension bar 50', which does not have an L-shaped end and has two retention or male ends.

In FIG. 6, the second corner arm 35 also has a recess 160 from the upper surface 125 to a midpoint 165 where the contact surface 130 meets the inner second corner arm surface 145. The recess 160 has a pivot pin hole 175 that aligns with the pivot pin hole 100 on the first corner arm 30, so that the pivot pin 110 and wingnut 105 removably connect and pivot the second corner arm 35 to the first corner arm 30 at their respective recesses 160 and 95 to allow the first corner arm 30 and the second corner arm 35 to pivot and to form different angles around the corner of the frame.

In FIG. 6, to connect the first and second corner arms together, the user will place the pivot pin 110 from the second corner arm 35, through the pivot pin hole 175, and into the first corner arm 30. The recess 95 of the first corner arm 30 will fit on top of the recess 160 of the second corner arm 35. The wingnut 105 secures the pivot pin 110 on the first corner arm 30.

In order to adjust the framing clamp 25 to achieve the proper and customized angle for a particular corner of the object to be clamped, in FIG. 6, where the contact surface 130 and the inner second corner arm surface 145 of the second corner arm meet and converge, one of the corners 185 of the recess 160 is slanted, and the edge 190 below this recess 160 is curved. Accordingly, on the first corner arm, where the contact surface 65 and the inner first corner arm surface 80 converge, the edge 192 above the recess 95 is curved also. When the first and second corner arms 30 and 35 are removably attached, these slanted and curved edges 185, 190, and 192 allow the first and second corner arms 30 and 35 to pivot to form the proper angle for the corner of the frame, as shown in FIGS. 1–4.

In FIG. 6., surrounding the pivot pin hole 175 are dentations 180 on the recess surface 170. These dentations 180 provide a guide to align the first corner arm 30 to the second corner arm 35 in order to further achieve the proper and customized angle for the particular corner of the frame or object to be clamped.

Referring to FIGS. 3 and 6, both the first corner arm 30 and the second corner arm 35 rest atop the bottom swivel support 40. The bottom swivel support 40 has a body 200 with a slot 205 that runs through the top surface 210 and the bottom surface 215. The slot 205 runs from one end to a point 225 short of the other end, resulting in a short end 230 and a long end 235. The long end 235 has less slot space because the slot 205 stops at the point 225 where the bottom swivel support 40 would form a corner of the corner assembly 20.

The slot 205 also allows for attaching the bottom swivel support 40 to the second corner arm 35. A connecting bolt 207 enters from the bottom surface 215, passes through the slot 205 and through the second corner arm 35, and is secured at the top surface 125 of the second corner arm 35 with a wing nut 240. Because the head of the connecting bolt 207 is wider than the connecting bolt's body, the connecting bolt 207 does not pass completely through the bottom swivel support 40.

The bottom swivel support 40 braces and supports the first and second corner arms 30 and 35 and the corner of the frame or the object to be clamped. In addition, the bottom swivel support 40 allows for adjustment around a corner of an object to be clamped. Because the connecting bolt 207 can slide along the length of the slot 205 of the bottom swivel support 40, the user not only can pivot both the upper and lower braces around their recess points, but the user can also slide the second corner arm 35 along the slot 205 to custom fit the corner and to adjust the angle formed by the second corner arm 35. This allows the second corner arm 35 to be adjusted to further provide greater flexibility in creating the proper fit around the frame and the corner to be clamped.

In addition, in FIGS. 3 and 4, the long end 235 of the bottom swivel support 40 has markings 245 on the top surface 210 that provide guides to properly align the first corner arm 30 for a predetermined angle for a frame or a multiple sided object. These markings can be measured for a three, four, five, or any multiple sided or cornered object. Thus, the user can further customize the clamp assembly around the corner of an object by aligning the first corner arm 30 with the markings 245 on the long end 235. Also, since the bottom swivel support 40 is only connected to the second corner arm via the connecting bolt 207, the bottom swivel support 40 can freely pivot at different angles under the first corner arm 30.

When this framing clamp is used for clamping the middle of tall objects, because the bottom swivel support 40 is able to pivot at different angles, the user can pivot the bottom swivel support 40 so that the slot 205 is parallel with the contact surface 130 of the second corner arm 35.

In FIG. 5, within the first corner arm, there is located the ratchet assembly 45. Each ratchet assembly 45 has a tension bar 50, a ratchet 260, a ratchet post 265, a spring 270, a spring post 275, a ratchet handle 85, and a handle pivot 280. The tension bar 50 enters the first corner arm 30 through a channel opening 250 on the inner first corner arm surface 80 and through a ratchet channel 255 and out the outer first corner arm surface 75. This ratchet channel 255 runs parallel with the top surface 55 and the bottom surface 60 of the first corner arm 30. The tension bar 50 then continues to the second corner arm 35 of the adjacent corner assembly. The tension bars 50 connect the corner assemblies 20 of the entire framing clamp 25 together.

The ratchet handle 85 has a resting and active position. As shown in FIG. 5, at rest, the ratchet handle 85 is approximately perpendicular to the tension bar 50 and occupies an interior compartment 295 of the first corner arm 30. In this embodiment, this handle 85 is movably connected to a ratchet 260*a* with a ratchet post 265*a*, a multitude of springs 270*a–d* with spring posts 275*a–d*, and a handle pivot 280. During operation of the ratchet assembly 45, the user presses the ratchet handle 85 towards the outer first corner arm surface 75.

There are two sets of teeth 285 and 290 on opposite sides of the tension bar 50. The teeth 285, 290 are only on two sides of the tension bar 50 so that in between the sets of the teeth 285, 290 are smooth and toothless sides 292 and 293 of the tension bar. The teeth on each side are spaced ⅛ inch apart, but these sets of teeth 285 and 290 are offset from each other so that the teeth are spaced approximately 1/16 inch from the teeth of the other side of the tension bar, so that different ratchets 260 will grasp different teeth 285, 290 to ensure travel of the tension bar 50 through the ratchet assembly 45 and tightening of the framing clamp 25. This offset of the sets of teeth allows the minimum travel of the tension bar through the ratchet assembly to be approximately 1/16 inch.

Further along the tension bar 50, there are two more ratchets 260*b* and 260*c* that are located on opposite sides of the tension bar 50 and are offset from each other. The ratchets 260*b* and 260*c* are pivotally attached to the interior compartment 295 of the first corner arm 30 with the ratchet posts 265*b–c*. The ratchets 260 are also attached to springs 270*a–d* on spring posts 275*a–d*, which provide a constant pressure on the ratchets to maintain their position on the teeth 285, 290 until pressure is released on the ratchet handle 85.

The tension bar has two ends: an L-shaped end 300 that lacks teeth and is located outside the first corner arm 30 and a retention end 305, which is thicker than the tension bar body 297 so that the tension bar will not slip through the ratchet assembly and is located in the second corner arm 35. The retention end 305, which is the male part, is held into place by and removably connects with a screw head 157, which is the female part.

In FIG. 6, because the sets of teeth 285, 290 of the tension bar are offset from each other by approximately 1/16 inch, in FIG. 6, this invention may employ soft rubber pads 310 and 315 placed on the contact surface 65 of the first corner arm and contact surface 130 of the second corner arm to take up any gap that may remain due to the offset teeth to guarantee a tight fit around the frame. In its resting position, the ratchet handle 85 engages the ratchets 260, which contact the teeth 285, 290 of the tension bar 50, and is urged by the springs 270 to prevent slippage of the tension bar 50.

In FIGS. 1 and 2, to use or to operate the framing clamp, after gluing the frame pieces and adjusting and pivoting the first and second corner arms 30, 35 and the bottom swivel support 40 to properly surround the corner of the frame, the user will place the frame within the framing clamp 25 and for each corner clamp 20, push the ratchet handle 85 a multiple number of times to cause the ratchet assembly to push the L-shaped end 300 of the tension bar 50 away from the inner first corner arm surface 80 in order decrease the side of the framing clamp 25 and to tighten the framing clamp 25.

As the ratchet handle 85 is pushed, the applied pressure pushes against the spring 270*a* connected against the ratchet handle 85 and also pushes against the spring 270*b* connected to the ratchet 260*a*. As the springs 270*a* and 270*b* are compressed, the ratchet 260*a* lifts up and disengages from one of the teeth 285. When the pressure on the ratchet handle 85 is released, the springs 270*a* and 270*b* urge the ratchet handle 85 back to its resting position. In addition, the ratchets 260*a–c* will grasp and contact the next adjacent tooth 285, 290 on the tension bar 50 and pull the L-shaped end 300 of the tension bar 50 away from the inner first corner arm surface 80.

During the movement of the ratchet handle 85 and as the ratchet 260*a* pulls the tension bar 50 along, the other ratchets 260*b* and 260*c* will be pushed off the teeth 285, 290, and the L-shaped end 300 of the tension bar 50 will move away from the inner first corner arm surface 80 to tighten the framing clamp. As the ratchet handle 85 returns to its resting position, the ratchets 260*b* and 260*c* will grasp and contact other nearby teeth 285, 290 on the tension bar 50 and lock the tension bar 50 into place.

After repeating the pressing of the ratchet handle 85, the user will be able to tighten the framing clamp 25 around the object to be clamped in a precise and graduated manner so that a tight fit can be maintained on all sides of the object. With the ratchet assembly 45, the user simply adjusts the framing clamp 25 by pushing on the ratchet handle 85 for each corner until a tight fit is reached. This is quite advantageous because adjustment of the framing clamp 25 can be done quite easily with the press of a handle instead of adjusting straps or levers.

When the glue or the adhesive has dried, to release the framing clamp, the user will twist the L-shaped end 300 of the tension bar so that the teeth 285, 290 are no longer in contact with the ratchets 260*a–c*. Because the smooth and toothless sides 292, 293 of the tension bar 50 are contacting the ratchets 260*a–c*, the user can push in the tension bar 50 to expand the framing clamp 25 and to release the frame.

In addition, in FIG. 5, there are a multitude of rubber feet 320 on the bottom surface 215 of the bottom swivel support 40 and the bottom of the surface 60 of the first corner arm 30 and the bottom surface 120 of the second corner arm 35. These rubber feet 320 hold the framing clamp 25 off the work or table surface.

FIGS. 2 and 4 show the framing clamp 25 for a three sided framing project. Not only can this framing clamp be applied to three or four sided objects, this invention can be applied to frames or objects with multiple corners. As long as the first corner arm 30 and the second corner arm 35 and the bottom swivel support 40 can be pivoted and adjusted to custom fit the corner to be clamped, then this invention can be usefully applied to any framing assembly project for a multiple sided or cornered object, such as a frame or a shadow box.

Another advantage of the claimed invention, the multi-corner clamp can be used on different heights of tall frames or shadow boxes to provide constant support and tension on all levels of a construction. For example, one framing clamp can be placed at the foot of the shadow box; another framing clamp in the middle; and another framing clamp at the head of the shadow box.

Instead of being located within the first corner arm, in another embodiment of the claimed invention, the ratchet assembly is located outside a clamp brace. FIGS. 7–10 show a second framing clamp 325 for securing together a frame having a plurality of corners. This framing clamp 325 comprises a number of corner assemblies 330, which are equal to the number of corners of the frame. Each corner assembly 330 has a corner clamp 335 and a ratchet assembly 340. Each corner clamp 335 has a rigid tension bar 345 extending therefrom and is adjustably connected to the corner clamp of another corner assembly, which define an interior space 350 in which a frame or an object to be clamped may be placed. The framing clamp 325 may be tightened around the frame to prevent the movement of the frame during assembly and gluing.

Figures 8, 9, 10:
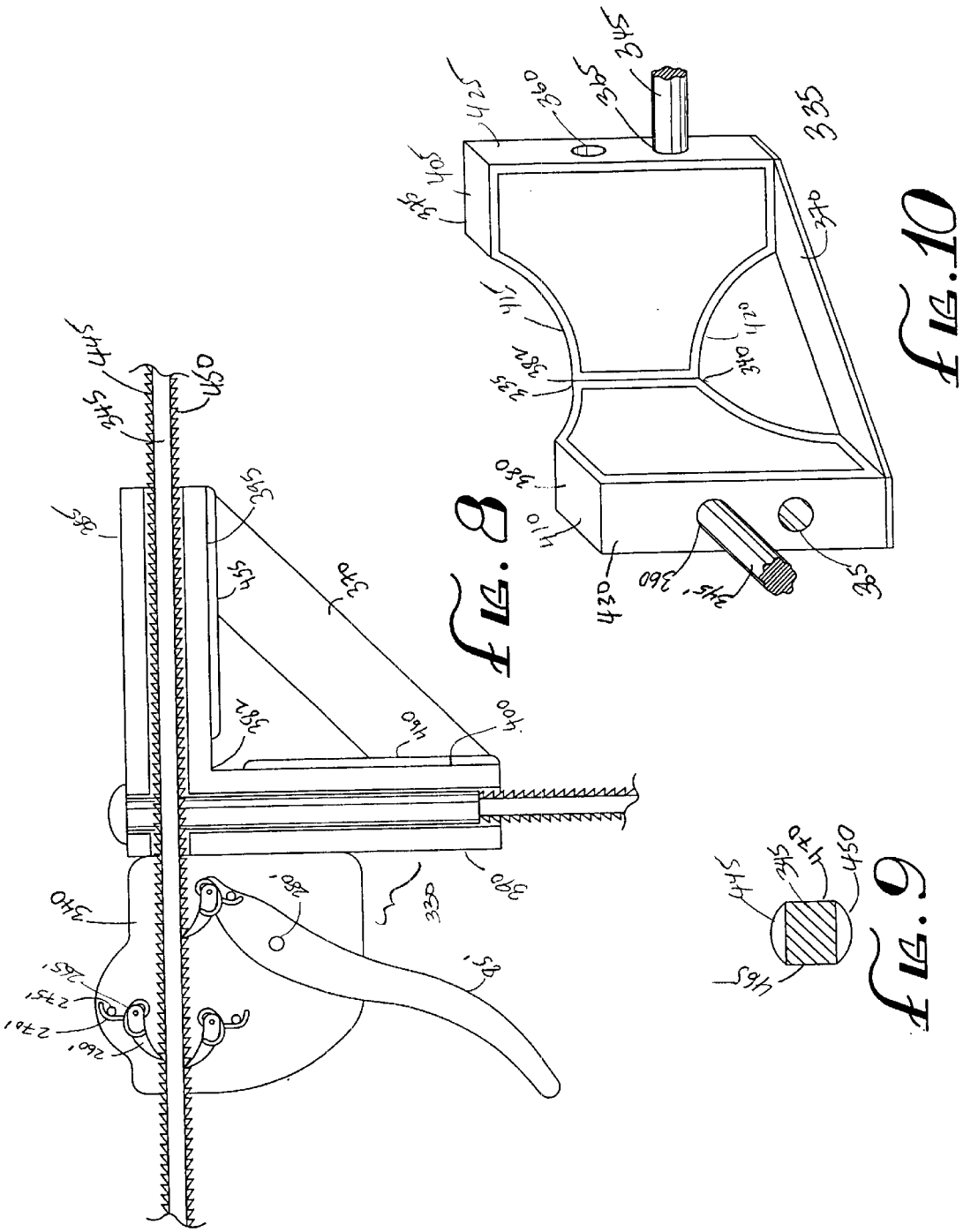
FIG. 8 is a cross-sectional view of the clamping mechanism of FIG. 7.
FIG. 9 is a cross-section view of the tension bar of FIG. 8.
FIG. 10 is a cross-sectional view of the corner of the clamping mechanism of FIG. 8.

In FIG. 8, the ratchet assembly 340 is very similar to the ratchet assembly 45 discussed above; each ratchet assembly 340 has a tension bar 345, a ratchet 260', a ratchet post 265', a spring 270', a spring post 275', a ratchet handle 85', and a handle pivot 280'. The main difference in this embodiment is that the ratchet assembly 340 is located outside the corner clamp 335 and may be covered by a protective cover 355. FIG. 9 shows a cross-sectional view of one embodiment of the tension bar 345 or the tension bar 50.

In FIGS. 7–10, the corner clamp 335 has a brace 370 and two body pieces 375, 380 to form a corner 382. The body pieces 375, 380 have outer surfaces 385, 390 and contact surfaces 395, 400. In the embodiment shown in FIGS. 7–10, there are also top surfaces 405, 410 and body edges 425, 430.

In the embodiment shown in FIGS. 7–10, each of the body pieces 375 and 380 of the corner clamp 335 has two channels 360, 365 through which the tension bars 345 pass. In FIG. 10, there are two channels of the body pieces 375 and 380 to prevent other tension bars from interfering with each other. Thus, parallel tension bars 345 would share the same channels, but perpendicular tension bars 345' would use different channels. Also, the multiple channels 360, 365 allow for the interchange of parts because the multiple channels 360, 365 facilitate matching up of corner assemblies 330 for different sized and shaped objects.

The body pieces 375 and 380 rest upon the brace 370. The brace 370 provides stability to the corner clamp 335 and a place for the frame to be held off the work surface. In addition, the body pieces have notches 415, 420 at the top 335 and bottom 340 of the corner 382 of the body pieces 375, 380 in order for excess glue or adhesive to leak or seep out of the object and to be wiped away.

As with the embodiment above, there are two sets of teeth 445, 450 on the tension bar 345. Because these sets of teeth 445, 450 may be offsetting, the contact surfaces 395, 400 have rubber cushioning 455, 460 in order to provide a tight fit using the ratchet assembly 340 and to also take up the 1/16 inch difference due to the offsetting sets of teeth 445, 450.

Figure 7:
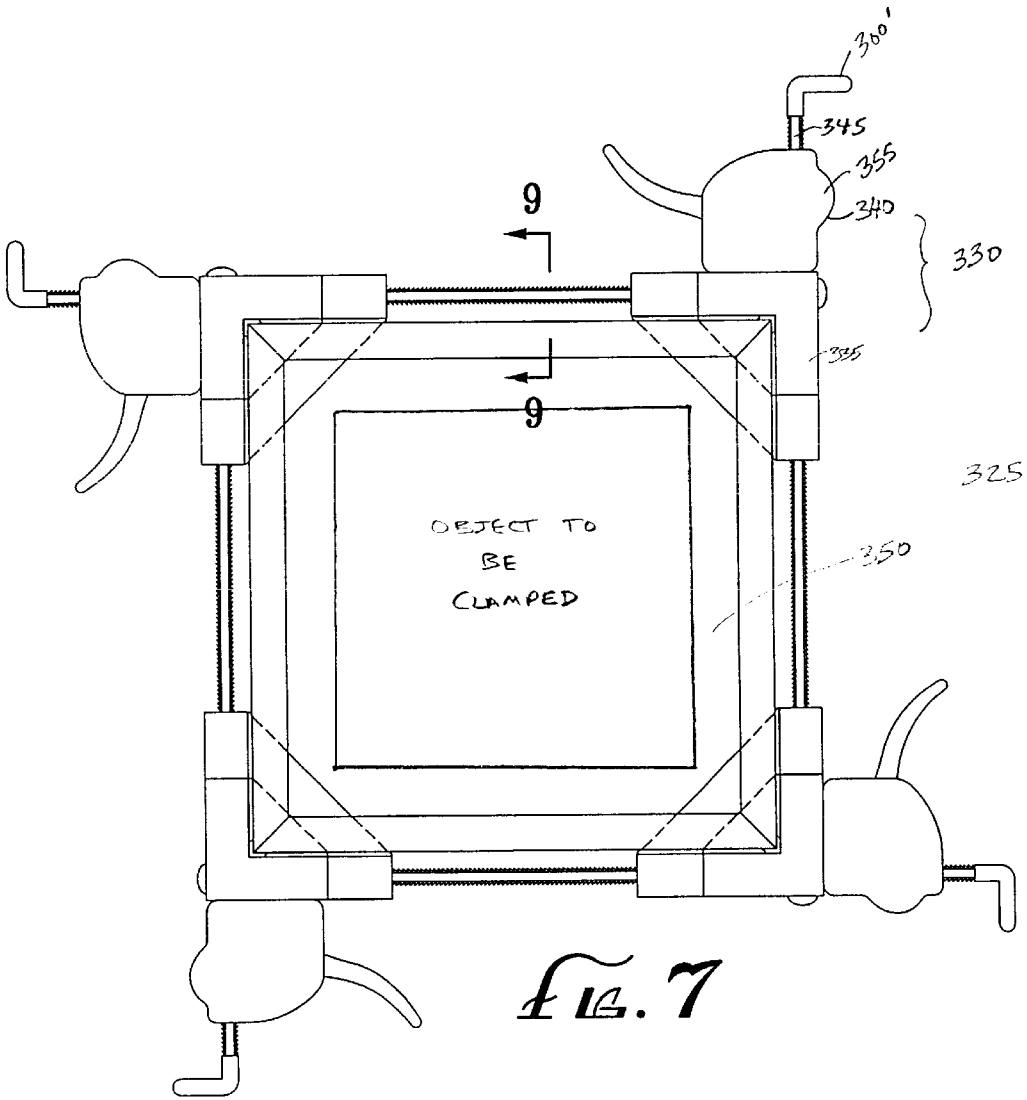
FIG. 7 is an overview of another embodiment of the claimed invention with the ratchet assembly outside the clamping brace.

In FIGS. 7 and 8, using this embodiment of the invention, the user would place the corner clamp 335 with the ratchet assembly 340 at each corner of the object to be held into place. Using the same ratchet assembly as described above the user would press down on the ratchet handle 85' a multiple number of times to push the L-shaped end 300' of the tension bar 345 away from the corner clamp 335 so that the framing clamp 325 will become smaller. The ratchet assembly 340 will allow for fine adjustment of the framing clamp 325 because the ratchets 260' will still provide constant tension even as adjustment is being done and because the object can be pressed against the rubber cushioning 455, 460 to have a snug fit.

When the glue or the adhesive has dried or set, to release the frame clamp, in FIG. 9, the user will twist the L-shaped end 300' of the tension bar so that the teeth 445, 450 are no longer in contact with the ratchets 260'. Like the tension bar 50 in the embodiment above, there are smooth and toothless sides 465, 470 on the tension bar 345 that alternate with the teeth 445, 450, so that when the L-shaped end 300' of the tension bar 345 is turned, the ratchets no longer contact the teeth 445, 450 but the smooth and toothless sides 465, 470. Then, the user can push in the tension bar 345 to expand the framing clamp and to release the frame. Further, for a tall object such as a shadow box, two sets of the framing clamp can be used to secure the top and bottom ends of the object to be framed.

The first corner arm 30, the second corner arm 35, or the bottom swivel support 40, can be constructed of any solid material such as metal, wood, or plastic. While the invention as described above in connection with preferred embodiments, it will be understood that it is not intended to limit the invention to those embodiments. On the contrary, it is intended to cover all alternatives, modifications, and equivalents as may be included within the spirit and scope of the invention as defined by the appended claims.

I claim:

1. A framing clamp for securing together a frame having a plurality of corners, said framing clamp comprising a number of corner assemblies equal to the number of comers of said frame, each corner assembly having a first corner arm pivotally connected to a second corner arm, said first and second arms each having a rigid tension bar extending therefrom and adjustably connecting to a corner arm of another comer assembly thereby defining an interior space in which said frame may be placed and about which said framing clamp may be tightened to prevent movement of said frame, said first corner arm having a contact surface, an outer surface, and a ratchet assembly, said ratchet assembly operably connected to said tension bar, said ratchet assembly having a ratchet, a ratchet post, a spring, a spring post, a ratchet handle, and a handle pivot, the first comer arm further comprises a handle window to allow access to the ratchet handle to activate the ratchet assembly to adjust the position of the tension bar and the framing clamp.

2. A framing clamp of claim 1 wherein the first corner arm has a top surface, a bottom surface, an outer first corner arm surface, and an inner first corner arm surface;

said first corner arm having a recess starting from the bottom surface to a midpoint of the first comer arm;

the first comer arm having a pivot pin hole to accommodate a pivot pin and a wingnut to pivot and to removably connect the first corner arm to the second corner arm;

the second corner arm having a recess, which has a pivot pin hole that aligns with the pivot pin hole on the first corner arm, wherein the pivot pin and the wingnut removably connect the second comer arm to the first corner arm; and said pivot pin allowing the first comer arm and the second comer arm to pivot and to form different angles around the comer of the frame.

3. The framing clamp of claim 2 wherein a corner of the recess of the second corner arm is slanted, said second corner arm has an edge below the recess, said edge is curved so that when the first and second corner arms are removably attached, said slanted and curved edges allow the first and second corner arms to pivot so that the proper angle can be achieved for the corner of the frame.

4. The framing clamp of claim 2 wherein the recess of the second corner arm has a multitude of dentations, said dentations provide a guide to help align the first corner arm to the second corner arm to achieve the proper angle for the corner of the frame.

5. The framing clamp of claim 1 wherein the tension bar has an L-shaped end and a retention end, said the retention end removably connects with a screw head, said retention end detaches from the screw head to connect to a connection adapter to add an extension or another tension bar.

6. The framing clamp of claim 1 wherein the second comer arm and the first corner arm have rubber pads to provide a tight fit around the frame.

7. A framing clamp for securing together a frame having a plurality of comers, said framing clamp comprising a number of comer assemblies equal to the number of corners of said frame, each corner assembly having a first corner arm pivotally connected to a second corner arm, said first and second arms each having a rigid tension bar extending therefrom and adjustably connecting to a corner arm of another comer assembly thereby defining an interior space in which said frame may be placed and about which said framing clamp may be tightened to prevent movement of said frame, said first comer arm having a contact surface, an outer surface, and a ratchet assembly, said ratchet assembly operably connected to said tension bar, said ratchet assembly having a ratchet, a ratchet post, a spring, a spring post, a ratchet handle, and a handle pivot, said second comer arm is removably and pivotally connected to a bottom swivel support, said bottom swivel support providing bracing and resting support to the first comer arm, the second comer arm, and the frame.

8. The framing clamp of claim 7 wherein the bottom swivel support has a slot for removably attaching the bottom swivel support to the second corner arm with a connecting bolt and a wingnut;

said connecting bolt can slide along the slot of the bottom swivel support so that the user can slide the second corner arm along the slot of the bottom swivel support to adjust the angle formed by the second corner arm around the corner of the object being clamped; and said bottom swivel support has a multitude of markings that provide guides to align the first corner arm for a predetermined angle for frame.

9. The framing clamp of claim 7 wherein there are a multitude of rubber feet on the bottom surface of the bottom swivel support, the first corner arm, and the second corner arm to hold the framing clamp off a work or a table surface.

10. A framing clamp for securing together a frame having a plurality of corners, said framing clamp comprising a number of comer assemblies equal to the number of corners of said frame, each corner assembly having a first comer arm pivotally connected to a second corner arm, said first and second arms each having a rigid tension bar extending therefrom and adjustably connecting to a corner arm of another comer assembly thereby defining an interior space in which said frame may be placed and about which said framing clamp may be tightened to prevent movement of said frame, said first comer arm having a contact surface, an outer surface, and a ratchet assembly, said ratchet assembly operably connected to said tension bar, said ratchet assembly having a ratchet, a ratchet post, a spring, a spring post, a ratchet handle, and a handle pivot, said tension bar has multiple sets of offset teeth, which are located on opposite sides of said tension bar;

the ratchets are pivotally attached to the first comer arm with said ratchet posts and are connected to springs on spring posts, which provide a constant pressure on the ratchets to maintain the position of the tension bar until pressure is released on the ratchet handle;

said sets of teeth are located on opposite sides of the tension bar and provide grasping points for the ratchets, and in between these sets of teeth are smooth and toothless sides of the tension bar that are not grasped by the ratchets;

said sets of teeth are offset so that the different ratchets will grasp different teeth to ensure travel of the tension bar through the ratchet assembly and tightening of the framing clamp;

said handle is movably connected to the ratchet with the ratchet post, the springs with the spring post, and the handle pivot, the ratchet handle, in a resting position, engages the ratchets, which contact the teeth of the tension bar, is urged by the springs to prevent slippage of the tension bar, and is approximately perpendicular to the tension bar.

* * * * *